US006837736B2

(12) United States Patent
Seltz

(10) Patent No.: US 6,837,736 B2
(45) Date of Patent: Jan. 4, 2005

(54) SOLENOID ELECTRICAL CONNECTION AND ELECTRICAL SPRING TERMINAL THEREFOR

(75) Inventor: Richard G. Seltz, Rochester Hills, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/271,913

(22) Filed: Oct. 15, 2002

(65) Prior Publication Data

US 2004/0072466 A1 Apr. 15, 2004

(51) Int. Cl.[7] ..... H01R 11/20
(52) U.S. Cl. ..... 439/395; 439/92
(58) Field of Search ..... 439/92, 347, 349, 439/34, 395, 544, 13

(56) References Cited

U.S. PATENT DOCUMENTS 5,241,746 A 9/1993 Herzog et al. ..... 29/882
6,379,162 B1 * 4/2002 Raypole et al. ..... 439/92
2002/0142630 A1 10/2002 Molus et al. ..... 439/76.1

FOREIGN PATENT DOCUMENTS

EP 1 172 903 1/2002

* cited by examiner

*Primary Examiner*—J. F. Duverne
(74) *Attorney, Agent, or Firm*—Roger A. Johnston

(57) ABSTRACT

A right angle configured spring contact terminal for a solenoid with a hooked end adjacent a region of contra-curvature adapted for contact with an electrical contact on an external mounting member. The opposite end is bifurcated for plug-in connection to a solenoid coil terminal receptacle. A plastic/elastomeric insulator is overmolded adjacent the right angle bend for inserting the hooked end in an aperture in the body structure upon which the solenoid coil is mounted.

17 Claims, 2 Drawing Sheets

SOLENOID ELECTRICAL CONNECTION AND ELECTRICAL SPRING TERMINAL THEREFOR

BACKGROUND OF THE INVENTION

The present invention relates to electrical connector terminals and particularly terminals for use with solenoid operators and more particularly for providing energization of the solenoid by making electrical connection through a mechanical operating member of the operating system into which the solenoid is assembled. An example of such a device is a solenoid operated dampening or flow restricting valve associated with an hydraulic shock absorber for a vehicle suspension wherein a mechanical member associated with the moveable parts of the shock absorber provides electrical contact for energizing the solenoid operated dampening valve in response to a control signal. In such shock absorber applications, the solenoid operated valve is operable to restrict the flow of hydraulic fluid in the shock absorber to alter the rate of flow and thus the dampening in the shock absorber. Such arrangements are employed in motor vehicle suspensions where it is desired to alter the stiffness or dampening rate of the shock absorbers in real time or on a running basis in response to changes in road conditions or driving patterns.

Heretofore in such vehicle suspension shock absorber application problems have been encountered with undesired movement of electrical contacts providing current to the solenoid coil from the deformation and relative movement between the shock absorber components which has resulted in permanent deformation of the contacts and early failure of the contacts. This problem has been particularly prominent in installations where the solenoid contact terminal is disposed in the attachment fitting portion of the solenoid valve body which is attached to the structural member such as the piston rod of a motor vehicle shock absorber. Heretofore, in solenoid valves for such installations, the contact terminal has been inserted through an aperture in the solenoid operated valve body such that upon assembly of a solenoid coil thereover the terminal makes a bayonet style or plug-in connection with a mating terminal on the solenoid coil. The electrical terminal has been provided with an insulator thereabout for insertion into an aperture in the attachment portion of the valve body and electrical isolation of the terminal from the valve body, which is typically formed of metal.

In such an aforesaid installation, it has been found extremely difficult to provide adequate deflectability or sufficiently low lateral spring rate of the electrical terminal to accommodate relative movement of the structural components because of the minimum space available for the formation of the electrical terminal in the mounting on the valve body. Thus, it has long been desired to provide an electrical terminal in a solenoid which is capable of withstanding the deformation without premature failure when subjected to high inertial loading caused by relative movement of the components of the systems in which the valve is installed.

BRIEF SUMMARY OF THE INVENTION

The present invention provides an electrical terminal adapted for external contact and connected by bayonet or plug-in connection with a solenoid coil when the terminal is installed in a valve operated by the solenoid. The terminal is installed in the attachment portion of the valve body for connection therewith upon assembly of the body into the system to be controlled by the valve, such as a shock absorber.

The present invention provides a spring type electrical terminal for mounting through an aperture and having a right angle configuration for effecting a plug-in connection thereto by a coil. The spring terminal has a hooked or folded end capable of absorbing contact by an external contact member upon installation in a structure, such as a shock absorber piston rod contact. The region of the terminal adjacent the hooked or folded end is formed with a contra curvature which cooperates with the hooked portion for lowering the lateral spring rate and absorbing deflection by the external contact. Insulating material is disposed over the right angle bend for enabling mounting of the terminal through an aperture in a metal valve body. In the presently preferred practice, the insulating material is plastic molded over the terminal and alternatively may be formed of or may include elastomeric material.

DETAILED DESCRIPTION OF THE INVENTION

Figure 1:
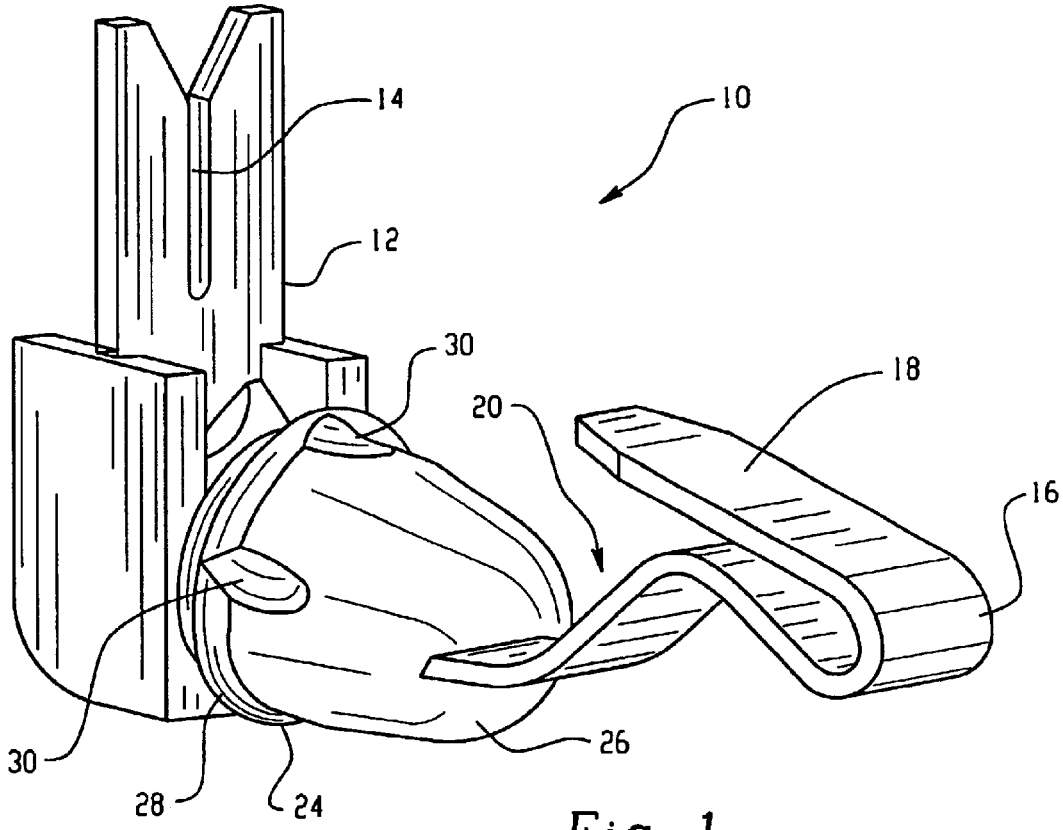
FIG. 1 is a perspective view of the terminal assembly of the present invention.
Figure 2:
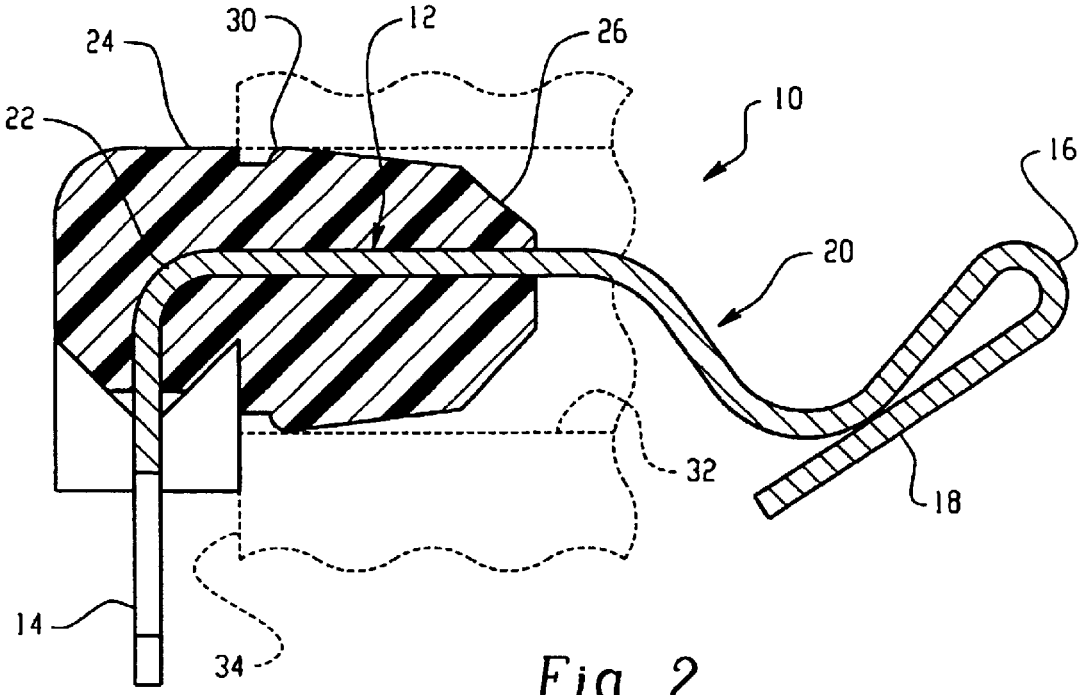
FIG. 2 is a cross-section of the terminal assembly of FIG. 1.
Figure 3:
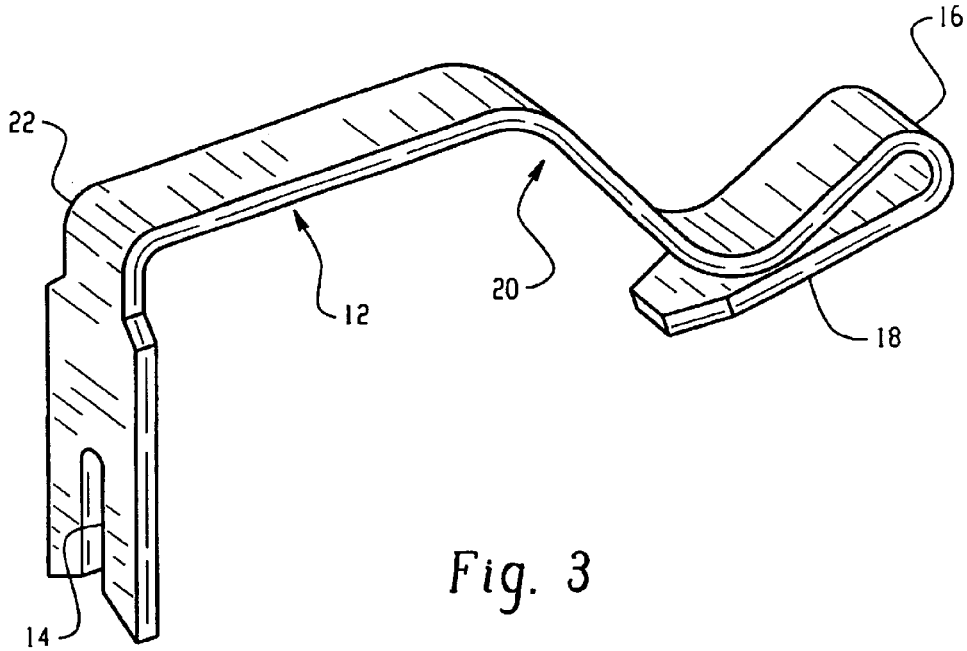
FIG. 3 is a perspective view of the spring terminal portion of the terminal of FIG. 1 prior to overmolding; and, FIG. 4 is a cross-section of a portion of a solenoid operated valve showing the installation of the terminal assembly of FIG. 1 therein.

Referring to FIGS. 1 through 3, the terminal assembly of the present invention is indicated generally at 10 and includes a deflectable terminal member formed of a strip of preferably spring tempered material indicated generally at 12.

In the presently preferred practice, strip 12 has a relatively thin rectangular shape in transverse section. The strip may be formed of a continuous length of relatively thin material having a generally flat transverse section. The strip 12 may be formed of material consisting essentially of copper.

Terminal member 12 has a bifurcated end 14 formed generally at right angles to the central portion of the terminal member 12 which bifurcated end 14 is adapted for bayonet or plug-in type connection thereto. The member 12 has a hook or folded portion 16 formed in the end thereof remote from bifurcation 14; and, the hook preferably has the open end thereof formed in a straight or planar configuration as denoted by reference numeral 18. The member 12 has a region indicated generally at 20 which is formed in contra curvature e.g. that has a reversal of curvature therein or S-shape, which portion 20 in conjunction with hook 16 provides for improved deflectability or lowered lateral spring rate for the terminal member 12.

The portion of the member 12 between contra curvature 20 and the bifurcated end 14 has a right angle bend 22 which has an insulator 24 formed thereon preferably by overmolding. The insulator 24 is preferably formed of plastic material but alternately may be formed of or may include elastomeric material. The insulator 24 has the end portion thereof adjacent contra curvature 20 provided with an annular taper 26 to facilitate installation as hereinafter will be described. In the presently preferred practice, the insulator 24 has an annular rib 28 formed thereon with a plurality of tapered deformable lugs adjacent thereto and spaced circumferentially thereabout to facilitate installation and retention.

Figure 4:
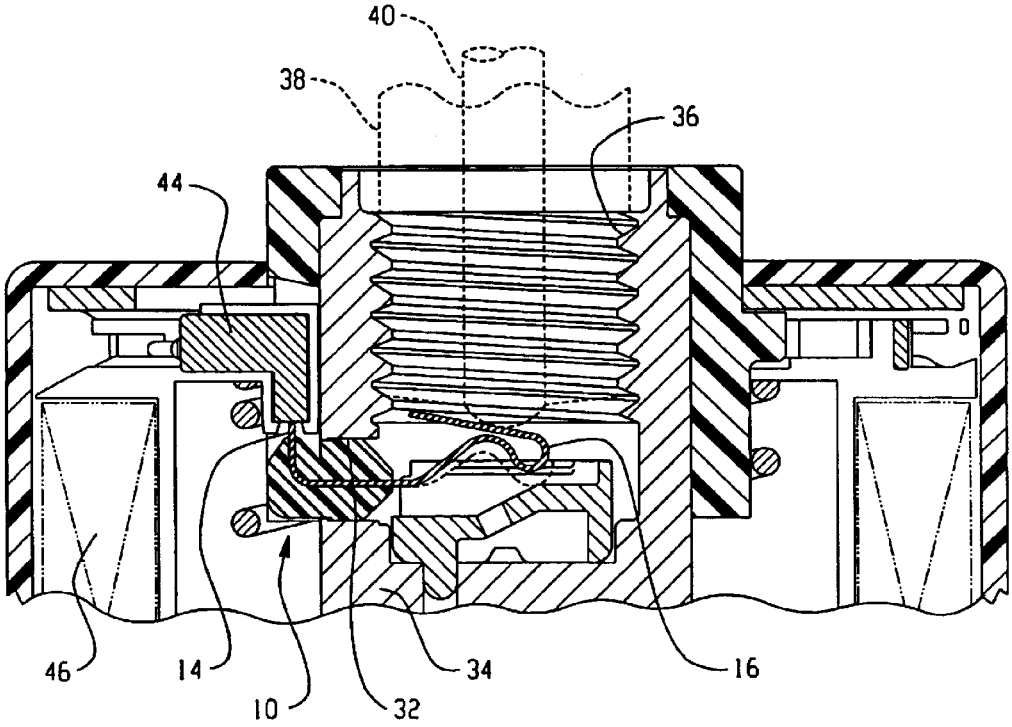

Referring to FIG. 4, the terminal assembly is shown installed in an aperture 32 formed in a valve body 34 by insertion of the hooked end of the terminal through the aperture and engaging the sides of the aperture with the rib 28 and lugs 30 by compression thereof, thereby frictionally retaining the terminal assembly in the aperture 32. The hook 16 and straight portion 18 extend into a threaded bore 36 formed in the valve body. In operation, the hook is deflected to close and move laterally to the position shown in dashed outline in FIG. 4 upon being contacted by the end of an electrical conductor 40 extending through external member 38 threadedly engaging bore 36 as shown in dashed line in FIG. 4. In the present practice of the invention member 38 is the piston rod of an hydraulic shock absorber, but may alternatively be any structural mounting member as for applications other than shock absorbers.

Upon assembly of a coil 46 over body 34, the bifurcated portion 14 of the terminal 12 is engaged in plug-in arrangement with a corresponding electrical terminal receptacle 44 provided with the solenoid coil 46.

The present invention thus provides a unique electrical terminal assembly which is capable of being installed through an aperture in a solenoid operated valve and extending into a limited space for making electrical contact with an external contact on an attachment structure engaging the solenoid valve. The terminal strip of the present invention is overmolded with insulating material and the strip has a region of contra curvature adjacent a hook shaped contact end for lowering the stiffness or lateral spring rate of the terminal. One end of the strip is bifurcated for plug-in connection to a solenoid coil on the valve body.

The present invention thus provides a unique and relatively low cost terminal contact for insertion in a valve body and for plug-in connection with the solenoid coil upon assembly to the valve body.

Although the invention has hereinabove been described with respect to the illustrated embodiments, it will be understood that the invention is capable of modification and variation and is limited only by the following claims.

What is claimed is:

1. A connector terminal assembly for insertion in an aperture in a solenoid comprising:

(a) an elongated strip of electrically conductive material with a generally right angle bend in the region of one end thereof and a hooked configuration at an end opposite said one end;

(b) a contracurvature formed adjacent said hooked end configuration operative for lowering the lateral spring rate thereof; and, (c) an overmold of insulating material formed over said right angle bend and having a mounting surface thereon adapted for insertion in a mounting aperture in the direction of said hooked configuration.

2. The terminal assembly defined in claim 1, wherein said overmold is formed of plastic material.

3. The terminal assembly defined in claim 1, wherein said overmold includes elastomeric material.

4. The terminal assembly defined in claim 1, wherein said overmold mounting surface includes a tapered portion adjacent said contracurvature.

5. The terminal assembly defined in claim 1, wherein said strip is bifurcated at said one end and said overmold is relieved to expose opposing edges of said bifurcation.

6. The terminal assembly defined in claim 1, wherein said strip has a relatively thin rectangular shape in transverse section.

7. The terminal assembly defined in claim 1, wherein said overmold mounting surface includes a generally cylindrical portion with an annular tapered portion for facilitating insertion into a mounting aperture.

8. The terminal assembly defined in claim 1, wherein said strip is formed of a continuous length of relatively thin material having a generally flat transverse section.

9. The terminal assembly defined in claim 1, wherein said strip is formed of material having a spring temper.

10. The terminal assembly defined in claim 1, wherein said strip is formed of material consisting essentially of copper.

11. A method of making a connector terminal assembly for a solenoid comprising:

(a) forming an elongated strip of electrically conductive material;

(b) forming a generally right angle bend in one end of the strip;

(c) forming a hook in an end of the strip opposite the one end;

(d) forming contracurvature adjacent said hook of said strip and lowering the lateral spring rate thereof; and, (e) overmolding said right angle bend with insulating material and forming a mounting surface on the overmolding for insertion in an aperture in the direction of said looped end.

12. The method defined in claim 11, wherein said step of forming a mounting surface includes forming a generally cylindrical tapered surface.

13. The method defined in claim 12, wherein said step of forming a generally cylindrical tapered surface includes forming an annular rib.

14. The method defined in claim 11, wherein said step of overmolding includes overmolding with elastomeric material.

15. The method defined in claim 11, wherein said step of forming an elongated strip includes forming a strip of spring temper material.

16. The method defined in claim 11, further comprising bifurcating said one end and exposing said bifurcation from said overmolding.

17. The method defined in claim 11, wherein said step of forming a region of contracurvature includes forming an S-shape configuration.

* * * * *